US008579145B2

(12) United States Patent
Gold et al.

(10) Patent No.: US 8,579,145 B2
(45) Date of Patent: Nov. 12, 2013

(54) INFANT FEEDING BOWL

(75) Inventors: Jonathan Morris Gold, London (GB); Daniel Jason Tyler, Milton Keynes (GB)

(73) Assignee: Brother Max Limited, Borehamwood (GB)

( * ) Notice: Subject to any disclaimer, the term of this patent is extended or adjusted under 35 U.S.C. 154(b) by 629 days.

(21) Appl. No.: 12/676,917

(22) PCT Filed: Sep. 11, 2008

(86) PCT No.: PCT/GB2008/003076

§ 371 (c)(1), (2), (4) Date: Mar. 8, 2010

(87) PCT Pub. No.: WO2009/037424

PCT Pub. Date: Mar. 26, 2009

(65) Prior Publication Data

US 2010/0206886 A1 Aug. 19, 2010

(30) Foreign Application Priority Data

Sep. 20, 2007 (GB) ..... 0718304.9
Mar. 28, 2008 (GB) ..... 0805614.5

(51) Int. Cl.
*A47G 19/02* (2006.01)

(52) U.S. Cl.
USPC ..... 220/574; 220/771; 206/541

(58) Field of Classification Search
USPC ..... 220/575, 541, 752, 755, 756, 757, 574, 220/254.1, 254.3, 254.7, 212, 769, 771, 220/574.3; 215/228; 206/541, 542, 815, 206/549
See application file for complete search history.

(56) References Cited

U.S. PATENT DOCUMENTS

| | | | | | |
|---|---|---|---|---|---|
| 132,558 | A | * | 10/1872 | Atterbury | 220/771 |
| 1,321,145 | A | * | 11/1919 | Price | 211/60.1 |
| 2,172,140 | A | * | 9/1939 | Kieft | 248/362 |
| 2,295,860 | A | * | 9/1942 | Oliver | 294/172 |
| 2,588,990 | A | * | 3/1952 | Sanchez | 220/575 |
| 2,886,225 | A | * | 5/1959 | Clarke | 220/23.83 |
| 3,028,039 | A | | 4/1962 | Clark | |
| 4,351,164 | A | | 9/1982 | Christiani | |
| 4,986,434 | A | * | 1/1991 | Prestyly, Jr. | 220/574 |
| 5,114,038 | A | * | 5/1992 | Laumann geb. Quensen | 220/575 |

(Continued)

FOREIGN PATENT DOCUMENTS

| | | | |
|---|---|---|---|
| DE | 9313088 | U1 | 8/1993 |
| DE | 20 2005 007738 | U | 10/2005 |

(Continued)

*Primary Examiner* — Jacob K Ackun
*Assistant Examiner* — Jenine Pagan

(57) ABSTRACT

There is provided an infant feeding bowl comprising a bowl container defining an inner bowl surface, an outer bowl surface and a bowl rim; and projecting away from said bowl rim, a bowl handle defining an arc form handle rim. The bowl handle includes a lamellar portion that extends from said handle rim to the bowl rim and provided to the lamellar portion, a thumbhole arranged for receipt of the user's thumb in use. The thumbhole is arranged symmetrically about a chord axis extending from the arc form handle rim to the bowl rim.

30 Claims, 18 Drawing Sheets

(56) References Cited

U.S. PATENT DOCUMENTS

| | | | | | |
|---|---|---|---|---|---|
| 5,174,452 | A | * | 12/1992 | Wang | 206/542 |
| 5,323,910 | A | * | 6/1994 | van de Graaf, Jr. | 206/557 |
| 5,361,932 | A | * | 11/1994 | Friedrich | 220/574 |
| 5,727,678 | A | * | 3/1998 | Chen | 206/217 |
| 5,950,856 | A | | 9/1999 | Cinque | |
| 7,000,799 | B1 | | 2/2006 | Hamre | |
| 2004/0262482 | A1 | * | 12/2004 | Lim | 248/311.2 |
| 2005/0218144 | A1 | | 10/2005 | Price | |
| 2006/0118562 | A1 | * | 6/2006 | Plantz et al. | 220/521 |
| 2006/0283866 | A1 | | 12/2006 | Mendenhall et al. | |
| 2008/0164177 | A1 | * | 7/2008 | Goren | 206/557 |
| 2010/0282760 | A1 | * | 11/2010 | Ebesu | 220/574 |

FOREIGN PATENT DOCUMENTS

| | | | |
|---|---|---|---|
| DE | 20 2006 004868 | U | 7/2006 |
| FR | 1416476 | A | 9/1964 |
| GB | 2007198 | A | 11/1977 |
| GB | 2118430 | A | 3/1982 |
| GB | 2284977 | A | 6/1995 |
| GB | 2361172 | A | 10/2001 |
| GB | 2405316 | A | 8/2003 |
| JP | 9285378 | A | 4/1996 |
| JP | 2002 345617 | A | 12/2002 |
| WO | WO 02/26087 | | 4/2002 |
| WO | WO 2004/047593 | | 6/2004 |

* cited by examiner

INFANT FEEDING BOWL

TECHNICAL FIELD

The present invention relates to a bowl that is arranged for use in the feeding of infants and toddlers.

BACKGROUND TO THE INVENTION

Bowls for use in feeding infants and toddlers ('infants') with foodstuffs ('infant feeding bowls') are well-known in the art. In a typical usage operation, the bowl container of the infant feeding bowl is charged with a foodstuff. The parent or carer then feeds the infant by abstracting portions of the foodstuff from the bowl container using an item of cutlery and directs those foodstuff portions to the mouth of the infant. As the infant gets older they may be allowed to hold and use the cutlery independently of the parent or carer.

In a common mode of usage the parent or carer (the 'user') will hold the bowl with one hand and use their other hand to transfer portions of foodstuff from the bowl to the mouth of an infant using a spoon or similar. This can be a messy operation as often the infant will resist feeding and may even make a grab for the bowl, which can thus potentially lead to spilling of the foodstuff contents thereof. Potential problems are exacerbated by the fact that the parent or carer may be holding the bowl with their less dominant hand or may switch hands during the feeding operation to better gain access to the infant with their hand that holds the spoon. It is therefore desirable that the bowl enables the user to securely hold it using one hand only. It is further desirable that such holding of the bowl is enabled regardless of whether the holding is in the parent or carer's dominant or less dominant hand. In other words, that 'ambidextrous' holding of the bowl is enabled. To address the above desiderata, Applicant has now devised an infant feeding bowl provided with a handle that specifically enables secure one-handed holding thereof by the user regardless of which hand is employed.

It is also common for infant feeding bowls to be provided with a sealing lid that is arranged for secure attachment to the rim of the bowl. The purpose of the sealing lid is to allow for a usage mode whereby the bowl is charged with a foodstuff and the lid secured thereto such that the now sealed-off contents may be carried around in the lidded bowl. Thus, commonly a foodstuff is prepared at home and stowed in the lidded bowl, which is carried round in a bag or pocket of the parent or carer for use in feeding the infant when away from the home. Conventionally, the sealing lid is arranged for snap-fit or push fit interaction with the rim of the bowl. Thus typically, the rim of the bowl is provided all around with a projecting snap-fit feature (e.g. an upstanding wall) or a recessing snap-fit feature (e.g. a groove). Applicant has realized that such snap-fit features present a food trap at the rim of the bowl, which can give rise to foodstuff wastage and makes for more difficult cleaning of the rim of the bowl. In solution to this problem, Applicant has now devised an infant feeding bowl that projects a rounded and smooth rim surface that is arranged for sealing interaction with an oppositely-rounded rim surface provided to the sealing lid.

It is an object of the present invention to provide an infant feeding bowl that is arranged for ease of holding by a user.

It is another object of the present invention to provide an infant feeding bowl with a sealing lid that minimizes any food traps.

SUMMARY OF THE INVENTION

According to a first aspect of the present invention there is provided an infant feeding bowl comprising a bowl container defining an inner bowl surface, an outer bowl surface and a bowl rim; and projecting away from said bowl rim, a bowl handle defining an arc form handle rim;

wherein said bowl handle includes a lamellar portion that extends from said handle rim to the bowl rim and provided to said lamellar portion, a thumbhole arranged for receipt of the user's thumb in use, and wherein said thumbhole is arranged symmetrically about a chord axis extending from the arc form handle rim to the bowl rim.

There is provided an infant feeding bowl. The bowl comprises a bowl container that defines an inner bowl surface, an outer bowl surface and a bowl rim. In embodiments, the bowl container defines a circular bowl container base, a circumferential bowl wall extending from the base, and a circular mouth defined by the uppermost (i.e. most distant from the base) extent of that circumferential bowl wall. The circumferential wall may in embodiments, extend perpendicular from the circular base or at an angle to that perpendicular (e.g. tapering outwards). The circumferential bowl wall thus, in these embodiments defines the general form of the inner and outer bowl surface. The circular mouth is in these embodiments, provided with the bowl rim. Non-circular form bowl shapes such as ovular forms are also envisaged.

The infant feeding bowl includes a bowl handle that projects away from the bowl rim such as to define an arc form handle rim (i.e. a handle rim in the form of an arc). Thus, in essence the handle of the bowl projects in (rounded) arch-like fashion away from the bowl rim.

It will be appreciated that the bowl rim defines a plane, which generally corresponds to the plane of the entry mouth of the bowl container. In embodiments, the arc form handle rim extends within or parallel to that plane defined by the bowl rim.

In other preferred embodiments, the arc form handle rim extends outwith and above or below that plane defined by the bowl rim. That is to say the arc form handle rim preferably projects away and upwards or downwards from (i.e. away from/towards the bowl container base) the bowl rim. Such configuration of the arc form handle rim has been round to assist with the user's holding of the bowl handle in one hand.

The arc form handle rim preferably defines a complete arc, although variations in which a 'broken arc' form (e.g. gap at the 'top of the arc') is employed are also envisaged.

In embodiments, the bowl rim and handle rim are formed as an integral part (e.g. as a single moulding). In other embodiments, the bowl rim and handle rim are formed as separate parts.

The bowl handle includes a lamellar portion that extends from the handle rim to the bowl rim. Thus, a lamellar or sheet-like portion extends from the arc for handle rim to the bowl rim to thereby occupy at least some of the space defined therebetween. It will be appreciated that where the arc form handle rim extends within or parallel to that plane defined by the bowl rim the lamellar portion also extends within or parallel to that plane and is thus, of planar form. It will further be appreciated that where the arc form handle rim extends outwith (e.g. above or below) that plane defined by the bowl rim the lamellar portion also extends outwith (e.g. above or below) that plane and is thus, of curved lamellar form.

A thumbhole arranged for receipt of the user's thumb in use, is provided to the lamellar portion. The hole may define any suitable form but is preferably, generally circular or ovular in form. The thumbhole is arranged symmetrically about a chord axis extending from the arc form handle rim to the bowl rim. Preferably, a chord is defined between the most distant (i.e. furthest away, extreme or 'top of the arc') position of the arc form handle rim relative to the bowl rim, and the thumbhole is arranged to lie generally symmetrically about that chord axis. It will be appreciated that in this description the chord axis is used as a geometric construct to indicate positioning of the thumbhole and which is not necessarily physically drawn or labelled on any part of the bowl handle itself. Such positioning of the thumbhole, symmetric about the chord axis, has been found to assist with ambidextrous use of the bowl handle since receipt of a user's right or left thumb is equally enabled. Applicant has also realized that where the thumbhole is offset from the chord axis receipt of one user's thumb over another is made preferential which negates any such ambidextrous utility.

Preferably, the bowl container is provided with a hand support feature (e.g. 'bulge' or 'protuberance') that protrudes (or 'extends') out from the outer bowl surface to define a hand support surface. In embodiments, that hand support feature is provided at a position on that outer bowl surface that matches up with the arc form handle rim. The purpose of the hand support surface is to provide a surface that may support the palm and/or one or more fingers of the user's hand when the bowl is held in one hand thereof with the user's thumb received by the thumbhole. Thus, in embodiments, the hand support feature defines a palm support surface and/or finger support surface. It will be appreciated that the hand support feature will thus, typically locate on the outer bowl surface at a position which lies below and between the points at which the arc form handle rim extends out from the bowl rim.

In embodiments, the hand support feature lies on or about a vertical plane extending through (i.e. containing) the chord axis that extends from the arc form handle rim to the bowl rim. In embodiments, the hand support feature lies symmetrically on or about a vertical plane extending through chord axis that extends from the arc form handle rim to the bowl rim.

The hand support feature may define any suitable form, but preferably defines a smooth hand support surface. In embodiments, the hand support feature defines a convex, such as dome form (e.g. hemispherical or ovular) hand support surface profile. The hand support feature extends (or 'protrudes') from the outer bowl surface to define a hand support surface (e.g. convex). In embodiments, the hand support feature defines a generally corresponding reverse surface (e.g. concave) that extends into the inner bowl surface. Thus, for example where a convex hand support surface is defined by an ovular bulge that protrudes from the outer bowl surface a corresponding concave reverse surface is defined at the inner bowl surface.

In embodiments, the reverse surface is arranged to provide a spoon wipe surface at the inner bowl surface. Thus, in use a loaded up spoon would be wiped against this spoon wipe surface to remove any excess foodstuff therefrom. Thus, it may be appreciated that in preferred embodiments the outer shape and form of the hand support feature is matched to define a suitable inner shape and form to the inner spoon wipe surface. Convex outer/concave inner forms have been found to be most suitable to meet this dual function, although alternative shape and forms may also be envisaged.

In embodiments, the bowl container is provided with a bowl insert that defines plural open compartments each arranged for holding a distinct portion of a foodstuff. In embodiments, the bowl insert is both receivable by and movable within the bowl container. The outer profile of the bowl insert is generally arranged to facilitate its receipt by the inner bowl surface, and thus the outer profile of the insert is generally bowl-like.

In embodiments, the bowl container and/or bowl insert are provided with any number of guides, tracks or grooves that guide movement of the bowl insert within the bowl container. In embodiments, the bowl insert is provided with an alignment feature (e.g. a protruding bulge) that is arranged to align with (e.g. be received at least partly by) the reverse surface of the hand support feature provided to the inner bowl surface. Thus, the bowl insert may be readily lined up at a defined position relative to the bowl container. More generally, the bowl insert may be rotatably movable within the bowl container about a rotational axis that centres at the centre point of the circular base of the bowl container.

The bowl insert is in embodiments, provided with plural (e.g. from two to six) open compartments each for holding a distinct portion of a foodstuff. In embodiments, the insert defines a generally bowl-like interior and the compartments are arranged in radially spaced fashion about that interior. Thus, each compartment suitably defines a segment of the bowl-like interior with each compartment being separated by compartment walls that extend from the central point of the bowl-like interior of the bowl insert (e.g. in propeller fashion).

In embodiments, the walls defining the periphery and separate compartments of the bowl insert are provided with an over-moulded edge (e.g. adhesively mounted or weld mounted thereto). In embodiments, gradated markings are provided along the inner surface of the compartment walls of the insert to allow the user to see how much foodstuff is present in the interior of each compartment of the insert.

In embodiments, a sealing lid is provided to the bowl container to close off the mouth thereof. That sealing lid interacts in suitable sealing fashion (e.g. snap-fit, screw-fit or push-fit) with the bowl rim. In embodiments, the sealing lid is provided with a retainer feature arranged to interact with the bowl insert to thereby prevent movement (e.g. rotation) of that insert when the sealing lid is in place. In embodiments, that retainer feature comprises a cavity shaped to receive part of the upper edge of the compartment walls of the insert. That cavity may for example be propeller-shaped and arranged to receive a propeller-like portion of the upper edge of the compartment walls. In embodiments, the sealing lid is provided with a lid cavity therein arranged for the receipt of one or more items of cutlery. In embodiments, one or more holding features are provided to that lid cavity for held receipt of the one or more items of cutlery. In embodiments a lid cavity cover is provided to that lid cavity. In embodiments, that lid cavity cover interacts in suitable fashion (e.g. snap-fit, screw-fit or push-fit) with a rim of the lid cavity. In embodiments, the lid cavity cover is provided with a spoon rest area (e.g. as an indent or protrusion provided thereto) that is arranged for rested receipt of a spoon during an infant feeding operation. In embodiments, the lid cavity cover hingedly mounts to the sealing lid.

In embodiments, the underside of the spoon rest area (i.e. the reverse surface thereof) is arranged to interact with an uppermost part (e.g. top of one or more compartments walls of) the bowl insert. In embodiments, when interacting in that manner the underside of the spoon rest areas acts such as to seal off one compartment of the bowl insert from another.

In embodiments, the sealing lid is provided with one or more pressure-release valve features such as one or more slit valves. The purpose of these valve features is to allow the infant feeding bowl to be placed in a microwave with the sealing lid on by enabling release of any built up steam pressure within the bowl container during microwave cooking or warming up of foodstuff contents thereof.

In embodiments, the outer bowl surface is provided at its lower end (e.g. at a base thereof) with one or more grip features for gripping to a surface (e.g. a table top or other planar surface) upon which the infant feeding bowl is placed. In embodiments, each of the one or more grip features comprises a mat or a sucker. In embodiments, a spaced arrangement (e.g. circular arrangement) of suckers is provided. In embodiments, the one or more grip features (e.g. suckers) are tucked away underneath the base of the container bowl such that no potential 'snagging' surfaces are presented when the infant feeding bowl is carried in the bag or pocket of a user.

Applicant has realized that conventional snap-fit or push-fit sealing lids for bowl containers of infant feeding bowls herein may present a food trap at the rim of the bowl. Applicant has therefore devised an infant feeding bowl that only presents a rounded and smooth rim surface that is arranged for sealing interaction with an oppositely-rounded rim surface provided to the bowl lid.

Thus, according to another aspect of the present invention there is provided an infant feeding bowl comprising a bowl container defining an inner bowl surface, an outer bowl surface and a bowl rim; and a bowl lid for said bowl container;

wherein said bowl rim defines only a convex rim surface and said bowl lid defines a lid rim defining a concave rim surface arranged for mating contact with said convex rim surface of the bowl rim.

In this aspect, the bowl rim of the bowl container defines only a convex rim surface, and thus includes none of the snap-fit projections and/or grooves of conventional sealing lids. Similarly, the bowl lid defines a lid rim defining a concave rim surface, and thus also includes none of the snap-fit projections and/or grooves of conventional sealing lids.

The concave rim surface of the lid rim is arranged for mating, such as flush mating, preferably sealing contact with the convex rim surface of the bowl rim. In preferred embodiments, that mating contact is partly or wholly at an inner-facing (i.e. towards the inner part of the bowl container) part of the convex rim surface.

In embodiments, the bowl rim defining the convex rim surface is provided to the bowl container as a separate moulded part thereto. That separate moulded part is thus, for example adhesively mounted or weld mounted to the bowl container. The use of a separate moulding for the bowl rim is in part driven by appreciation that forming of the required convex rim surface would be difficult using an integral moulding since the tool would not be able to release cleanly from the mould.

In embodiments, the bowl rim defines an essentially circular or ovular cross-sectional profile such that the convex rim surface thereof is defined as part of the circumference thereof. In embodiments, the concave rim surface of the bowl lid interacts with from 100 to 250°, preferably from 120 to 200° radial segment of that circumference. In embodiments, the lid rim defines an inner circumferential skirt, which projects downwards therefrom. In embodiments, a circumferential groove is defined in combination between the inner circumferential skirt, part of the convex rim surface and a circumferential bowl wall which defines (the upper part of) the inner bowl surface. In embodiments, that circumferential groove is arranged for receipt of the uppermost part (e.g. top of a circumferential wall of) a bowl insert that is receivable by the bowl container, thereby securing that bowl insert within the lidded bowl container.

To provide both one-handed holding and ambidextrous utility, the infant feeding bowl herein suitably provides a thumbhole that is arranged symmetrically about the chord axis extending from the arc form handle rim to the bowl rim. Applicant has however, also realized that an alternative form of infant feeding bowl having one-handed holding utility may also be provided.

Thus, according to a further aspect of the present invention there is provided an infant feeding bowl comprising a bowl container defining an inner bowl surface, an outer bowl surface and a bowl rim; and projecting away from said bowl rim, a bowl handle defining a partial arc form handle rim;

wherein said bowl handle includes a lamellar portion that extends from said partial arc form handle rim to the bowl rim and wherein a thumbhole arranged for receipt of the user's thumb in use, is defined in combination by the partial arc form handle, said lamellar portion and the bowl rim.

In this aspect, the infant feeding bowl includes a bowl handle that projects away from the bowl rim such as to define a partial arc form handle rim (i.e. a handle rim in the form of a partial arc). Thus, in essence the handle of the bowl projects in (rounded) part arch-like fashion away from a single point the bowl rim. In embodiments, the end of the partial arc form handle is rounded. In embodiments, the partial arc form handle thickens out towards its end. As before, the bowl rim defines a plane, which generally corresponds to the plane of the entry mouth of the bowl container. In embodiments, the partial arc form handle rim extends within or parallel to that plane defined by the bowl rim.

In other preferred embodiments, the partial arc form handle rim extends outwith and above or below that plane defined by the bowl rim. That is to say the partial arc form handle rim preferably projects away and upwards or downwards from (i.e. away from/towards the bowl container base) the bowl rim. Such configuration of the partial arc form handle rim has been round to assist with the user's holding of the bowl handle in one hand.

In embodiments, the bowl rim and partial arc form handle rim are formed as an integral part (e.g. as a single moulding). In other embodiments, the bowl rim and handle rim are formed as separate parts.

The bowl handle includes a lamellar portion that extends from the handle rim to the bowl rim. Thus, a lamellar or sheet-like portion extends from the arc for handle rim to the bowl rim to thereby occupy at least some of the space defined therebetween. It will be appreciated that where the partial arc form handle rim extends within or parallel to that plane defined by the bowl rim the lamellar portion also extends within or parallel to that plane and is thus, of planar form. It will further be appreciated that where the partial arc form handle rim extends outwith (e.g. above or below) that plane defined by the bowl rim the lamellar portion also extends outwith (e.g. above or below) that plane and is thus, of curved lamellar form. A thumbhole arranged for receipt of the user's thumb in use, is defined in combination by the partial arc form handle, said lamellar portion and the bowl rim. The hole may define any suitable form but is preferably, generally circular or ovular in form.

In embodiments, the bowl container is provided with a hand support feature (e.g. 'bulge' or 'protuberance') that protrudes (or 'extends') out from the outer bowl surface to define a hand support surface. In embodiments, that hand support feature is provided at a position on that outer bowl surface that matches up with the partial arc form handle rim. As before, the purpose of the hand support surface is to provide a surface that may support the palm and/or one or more fingers of the user's hand when the bowl is held in one hand thereof with the user's thumb received by the thumbhole. Thus, in embodiments, the hand support feature defines a palm support surface and/or finger support surface. It will be appreciated that the hand support feature will thus, typically locate on the outer bowl surface at a position which lies below the point at which the partial arc form handle rim extends out from the bowl rim.

The hand support feature may define any suitable form, but preferably defines a smooth hand support surface. In embodiments, the hand support feature defines a convex, such as dome form (e.g. hemispherical or ovular) hand support surface profile. The hand support feature extends (or 'protrudes') from the outer bowl surface to define a hand support surface (e.g. convex). In embodiments, the hand support feature defines a generally corresponding reverse surface (e.g. concave) that extends into the inner bowl surface. Thus, for example where a convex hand support surface is defined by an ovular bulge that protrudes from the outer bowl surface a corresponding concave reverse surface is defined at the inner bowl surface.

In embodiments, the reverse surface is arranged to provide a spoon wipe surface at the inner bowl surface. Thus, in use a loaded up spoon would be wiped against this spoon wipe surface to remove any excess foodstuff therefrom. Thus, it may be appreciated that in preferred embodiments the outer shape and form of the hand support feature is matched to define a suitable inner shape and form to the inner spoon wipe surface. Convex outer/concave inner forms have been found to be most suitable to meet this dual function, although alternative shape and forms may also be envisaged.

Generally, the infant feeding bowl herein is formed of a plastic polymer material. In embodiments, the sealing lid is clear in form (e.g. colourless) to allow the user to see how many portions of foodstuff remain (i.e. how many compartments are still to be dispensed from) without removing that lid.

It will be appreciated that any of the elements of the infant feeding bowl herein may be manufactured and supplied separately and/or supplied as a pre-assembly or a kit of parts. The present invention encompasses all of these separate component parts and any assemblies thereof.

BRIEF DESCRIPTION OF THE DRAWINGS

The invention will now be described further with reference to the accompanying drawings, in which:—

Referring now to the drawings, FIG. 1 shows in exploded view an infant feeding bowl 1 herein comprising a bowl container 10 defining a bowl rim 12 and projecting therefrom, a bowl handle 20 defining an arc form handle rim 22 with central thumbhole 24. That infant feeding bowl 1 is provided with a base support 30 provided with plural suckered feet 32; a bowl insert 40; a sealing lid 50 defining a sealing lid cavity 52 arranged for receipt of items of cutlery 58, 59; and provided with a sealing lid cavity cover 60.

FIG. 2 shows that infant feeding bowl 1 in assembled form as would be adopted in use, when the feeding bowl 1 is carried in the pocket or bag of a user. It will be noted that the suckered feet 32 tuck away nicely under the bowl container 10, thereby minimizing any snagging potential. Sealing lid cavity cover 60 is in 'hinged down' relationship (i.e. closed about hinge 62) to the sealing lid 50, thereby closing off the sealing lid cavity 52 to keep the items of cutlery 58, 59 secured therein. It will also be seen that upturned overhanging part 54 of the sealing lid 50 seats above the handle rim 22 and central thumbhole 24, which arrangement may be appreciated to assist ready removal of the sealing lid 50 by means of a user pushing up (e.g. through the thumbhole 24) on the underside of the overhanging part 54.

FIG. 3 shows that same infant feeding bowl 1, but now with the sealing lid cavity cover 60 in 'hinged open' relationship (i.e. open about hinge 62) to the sealing lid 50, thereby opening the sealing lid cavity 52 to make the items of cutlery 58, 59 accessible to the user. Also, now more visible is sub-divider 54 provided interior to the sealing lid cavity 52 to divide off one item of cutlery 58 from the other 59, and in embodiments also to grip one or either item 58, 59 of cutlery. Also, now more visible is spoon rest area 64 provided as an indent to lid cavity cover 60 and arranged for resting of a spoon 58 on the underside thereof during an infant feeding operation.

FIG. 4 shows more detail of the relationship between the bowl container 10 and its base support 30. Thus, bowl container 10 may be seen to define an inner bowl surface 11; an outer bowl surface 13; and a bowl rim 12 from which bowl handle 20 projects. The lower part of the bowl container 10 may be seen to define a peripheral bowl skirt 14 arranged for receipt of the base support 30.

Figure 8:
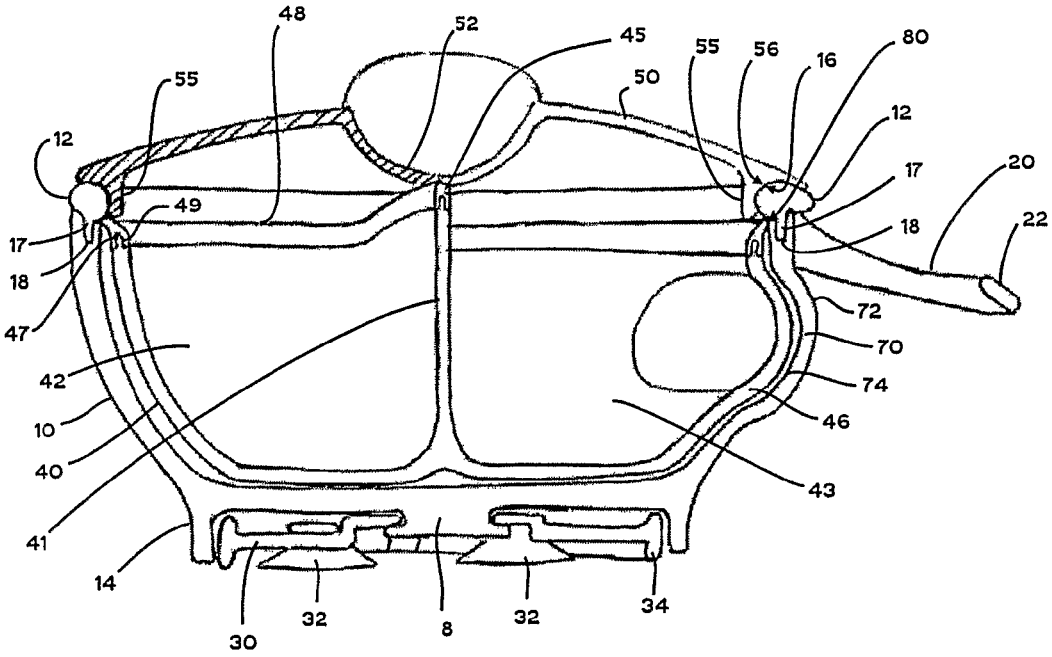
FIG. 8 shows a sectional view of the infant feeding bowl of FIGS. 1 to 3 but shown absent any cutlery.

Referring also to FIG. 8, it may be seen that base support 30 mounts to a central mounting 8 provided centrally at the underside of the bowl container 10. Suckered feet 32 are provided to the base support 30 and project downwards such as to provide suckering contact with a planar surface (e.g. table top) upon which the bowl is placed. The base support 30 itself, is also provided with a peripheral skirt 34 that in combination with the peripheral bowl skirt 14 acts to keep the suckers 32 tucked away in use, and also during travel.

Figure 1:
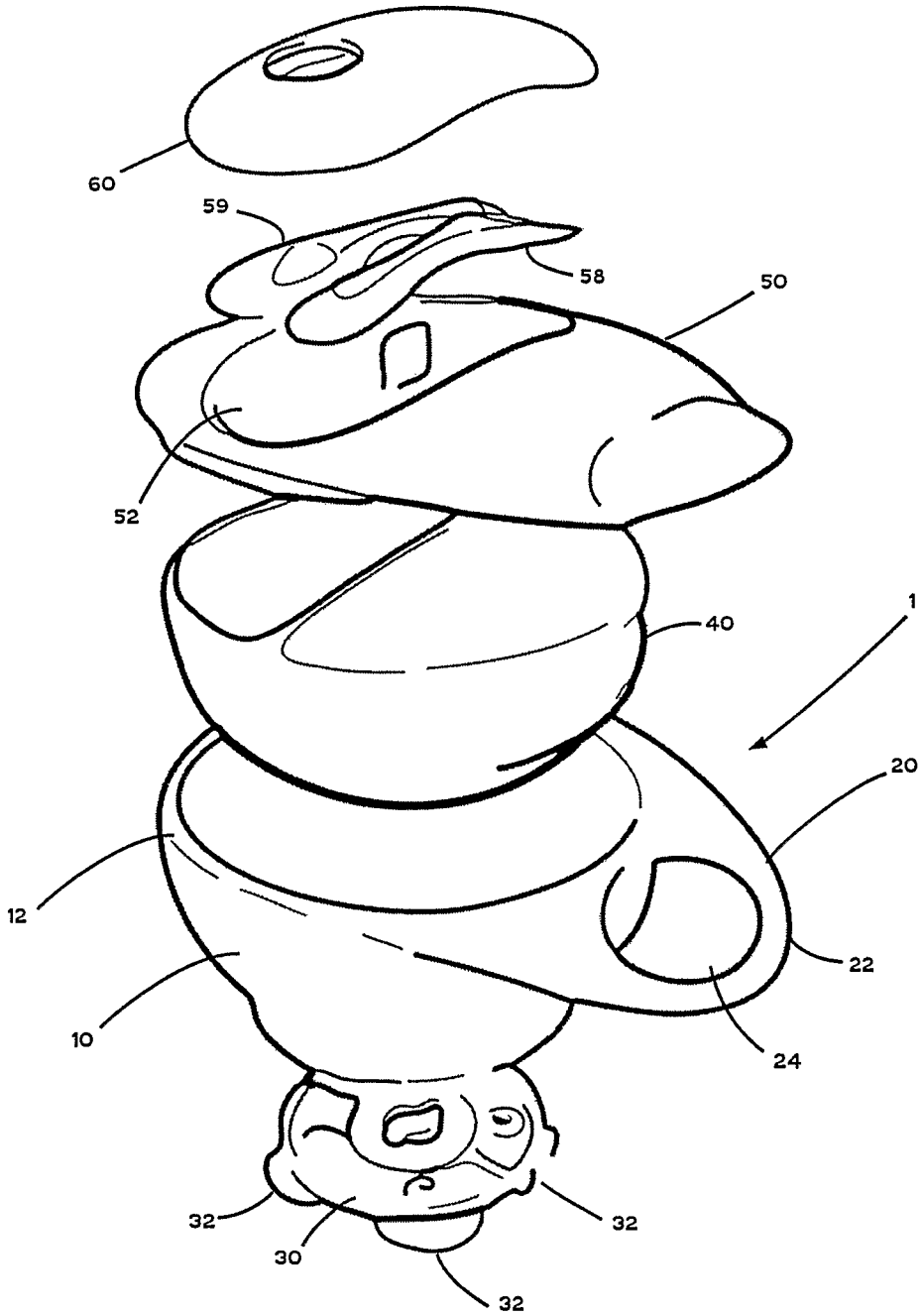
FIG. 1 shows an exploded view in perspective of an infant feeding bowl herein also provided with suckered base, bowl insert, sealing lid, cutlery and sealing lid cavity cover.
Figure 2:
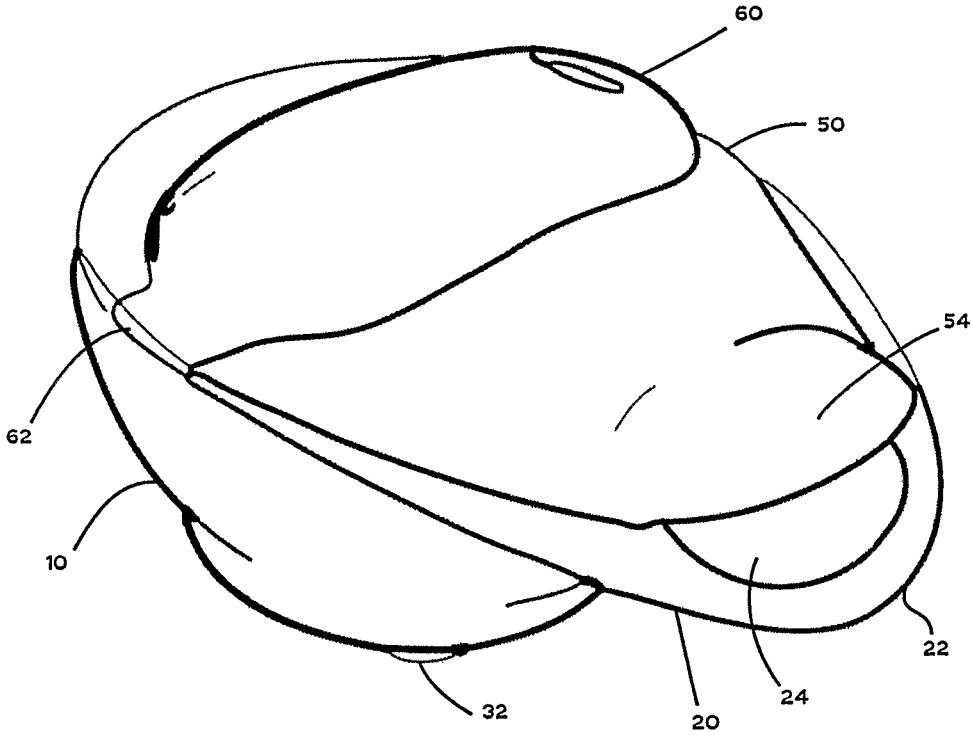
FIG. 2 shows a perspective view of the infant feeding bowl of FIG. 1 in a travel (i.e. 'packed away') configuration thereof.
Figure 3:
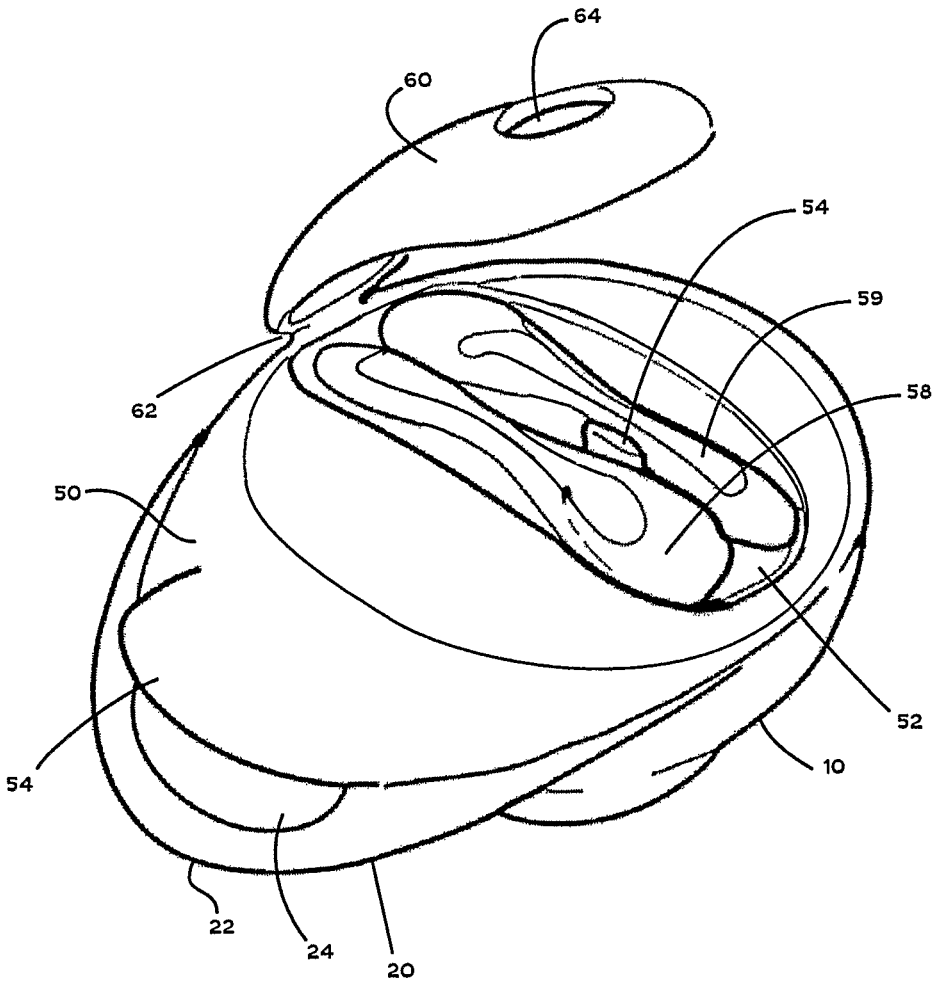
FIG. 3 shows a perspective view of the infant feeding bowl of FIGS. 1 and 2 with the sealing lid cavity cover in an open configuration.
Figure 4:
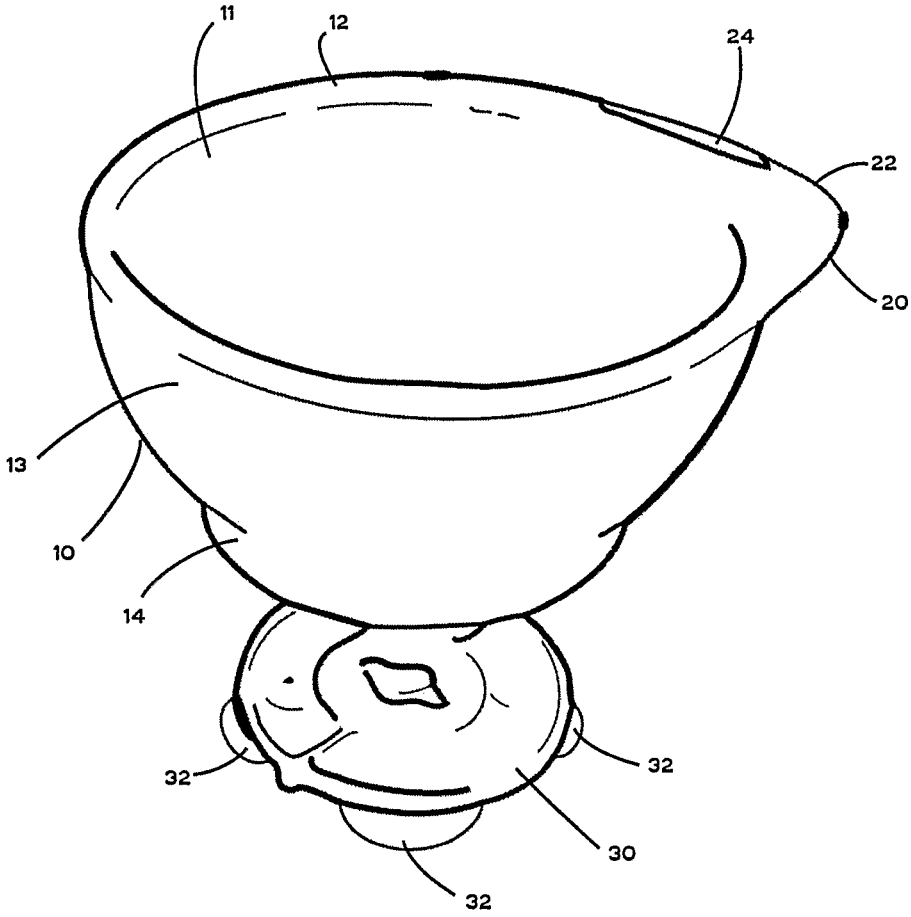
FIG. 4 a perspective view of an infant feeding bowl herein shown in exploded view relative to a suckered base portion thereof.
Figure 5:
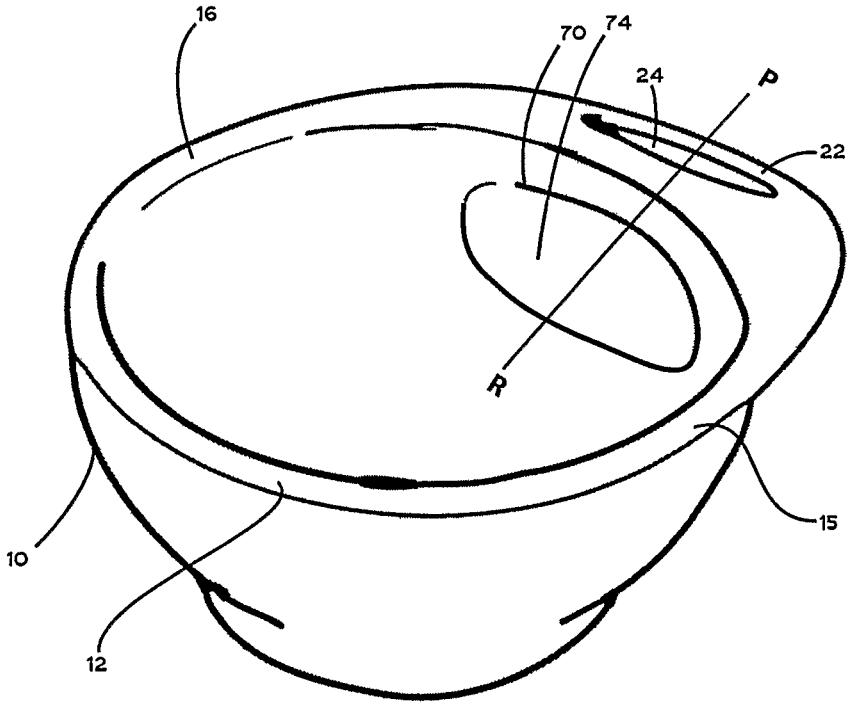
FIG. 5 shows a perspective view of an infant feeding bowl herein showing detail of a spoon rest area provided to the inner bowl surface.
Figure 6:
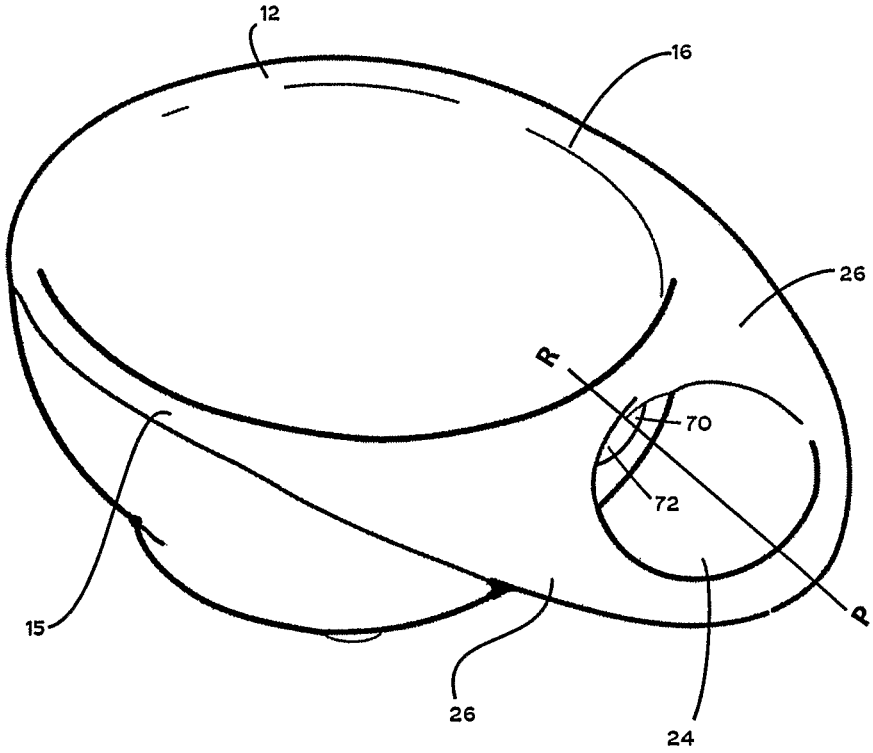
FIG. 6 shows a perspective view of the infant feeding bowl of FIG. 5 herein showing detail of the handle rim thereof.

FIGS. 5 and 6 shows more detail of the relationship between the bowl container 10, its bowl rim 12 and the bowl handle 20. Thus, the bowl handle 20 may be seen to extend generally at two points 15, 16 from the bowl rim 12 to define an arc form handle rim 22, although it will also be appreciated that the bowl rim 12 and the arc form handle rim 22 are integrally formed. Lamellar portion 26 extends from the arc form handle rim 22 to the bowl rim 20 and is provided with a thumbhole 24 arranged for receipt of the user's thumb in use.

FIGS. 5 and 6 illustrate a chord axis P-R extending from the peak 'P' of the arc form handle rim 22 to the rim 12 of the bowl container 10. It will be seen that the thumbhole 24 is of generally circular form and is arranged symmetrically about that chord axis. Such symmetric arrangement has been found to enable ambidextrous use (i.e. holding in either the user's left or right hand) of the bowl container 10.

Referring now also to FIG. 8, it will be appreciated that the arc form handle rim 22 extends downwards relative to the plane defined by the bowl rim 12 such that the lamellar portion 26 is of curved lamellar form. It may also be seen that the bowl container 10 is provided with a hand support feature 70 in the form of a bulge that protrudes from the outer bowl surface to define a convex outer hand support surface 72. That hand support feature 70 lies symmetrically about a vertical plane containing the chord axis P-R that extends from the arc form handle rim 22 to the bowl rim 12. In use, the hand support feature 70 defines a support surface 72 for supporting the user's palm and optionally also the user's fingers. It may also be seen that the hand support feature 70 defines a reverse surface 74 of concave surface profile that extends into the inner bowl surface 11. In use, this reverse surface 74 provides a spoon wipe surface at the inner bowl surface 11.

Figure 7:
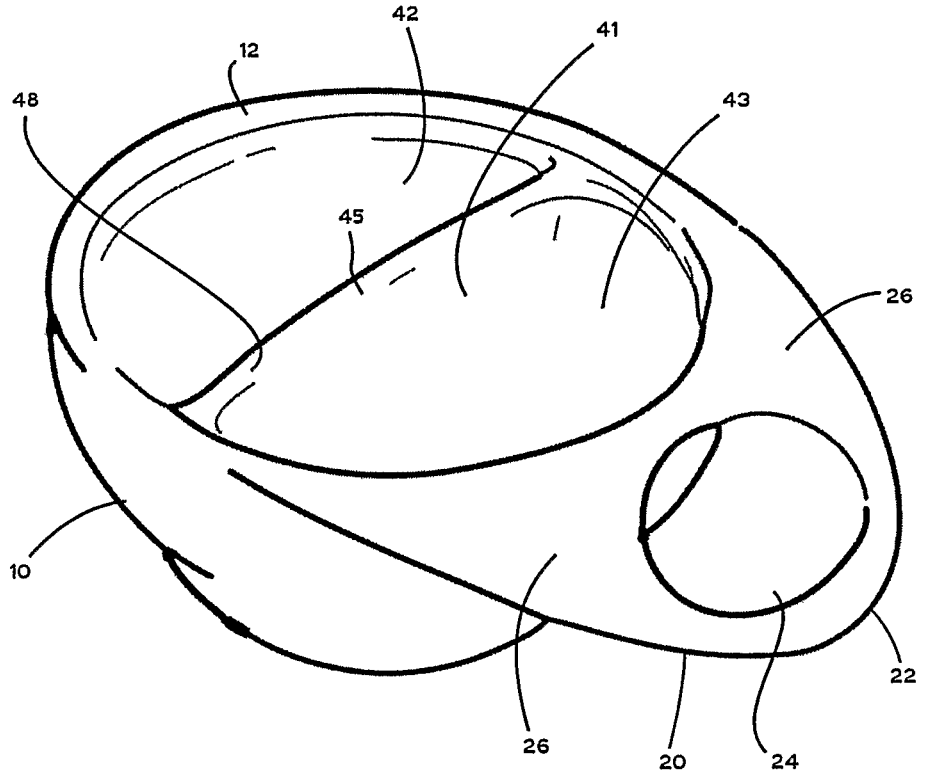
FIG. 7 shows a perspective view of the infant feeding bowl of FIGS. 5 and 6 now provided with a bowl insert.

Referring now to FIG. 7 and also to FIG. 8, the bowl container 10 is now provided with bowl insert 40 having a central dividing wall 41 that defines two semi-circular open compartments 42, 43 each arranged for holding a distinct portion of a foodstuff. The bowl insert 40 is provided with an alignment feature 46 in the form of a bulge that is arranged to align with the reverse surface 74 of the hand support feature 70 provided to the inner bowl surface 11, thereby lining up/securing the bowl insert 40, in use thereof.

Details of the mating arrangement between the sealing lid 50 and bowl rim 12 are now described in particular relation to FIG. 8. In more detail, bowl rim 12 may be seen to be provided to the bowl container 10 as a separate moulded part thereof, wherein on assembly of the separate parts circumferential plug 17 of the bowl rim is received and adhesively mounted or weld mounted within circumferential slot 18 provided to the top of the bowl container 10. When so-assembled, the bowl rim 12 defines only a convex rim surface 16, which is arranged for sealing contact with a concave rim surface 56 of the sealing lid 50.

In greater detail, the bowl rim 12 may be seen to define a circular cross-sectional profile such that the convex rim surface 16 thereof is defined as part of the circumference thereof. The sealing lid 50 may is provided with an inner circumferential skirt 55, which projects downwards therefrom, and to which there is provided concave rim surface 56. When in sealing contact, the concave rim surface 56 of the sealing lid 50 interacts with a radial segment (e.g. from 100 to 250°) of that circumference, which defines the convex rim surface 16 of the bowl rim.

It will also be seen that a circumferential groove 80 is defined in combination between the inner circumferential skirt 55 of the sealing lid 50, part of the convex rim surface 16 and the circumferential bowl wall which defines the upper part of the inner bowl surface 11. That circumferential groove 80 is arranged for receipt of the uppermost part 48 of bowl insert 40 when received by the bowl container 10. That uppermost part 48 of bowl insert 40 may be seen to be provided as a separate moulded part thereof, wherein on assembly of the separate parts circumferential plug 47 of the insert wall 41 is received and adhesively mounted or weld mounted within slot 49 provided to the top of the bowl insert 40. Additionally, the central part 45 of the upper part 48 of the bowl insert 40 interacts with the underside of the sealing lid cavity 52. Thus, the bowl insert 40 is securely held within the bowl container 10.

Figure 9:
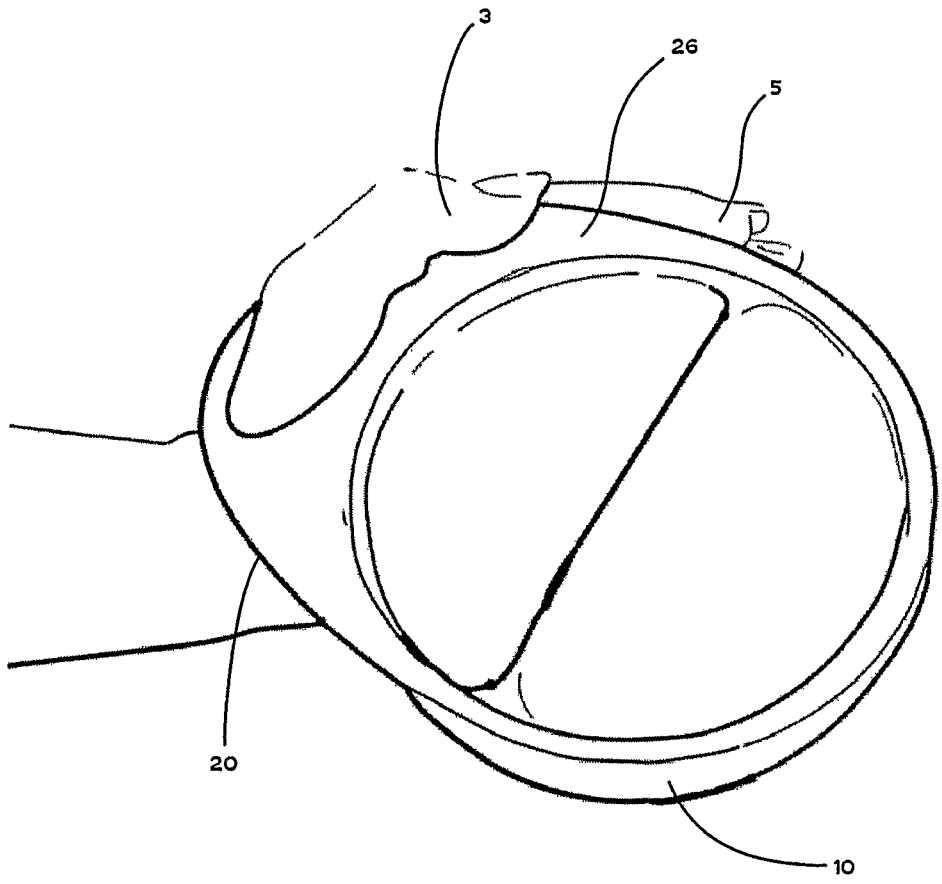
FIGS. 9 and 10 show different perspective views of the infant feeding bowl with bowl insert of FIG. 7 as held in a single hand of a user.
Figure 10:
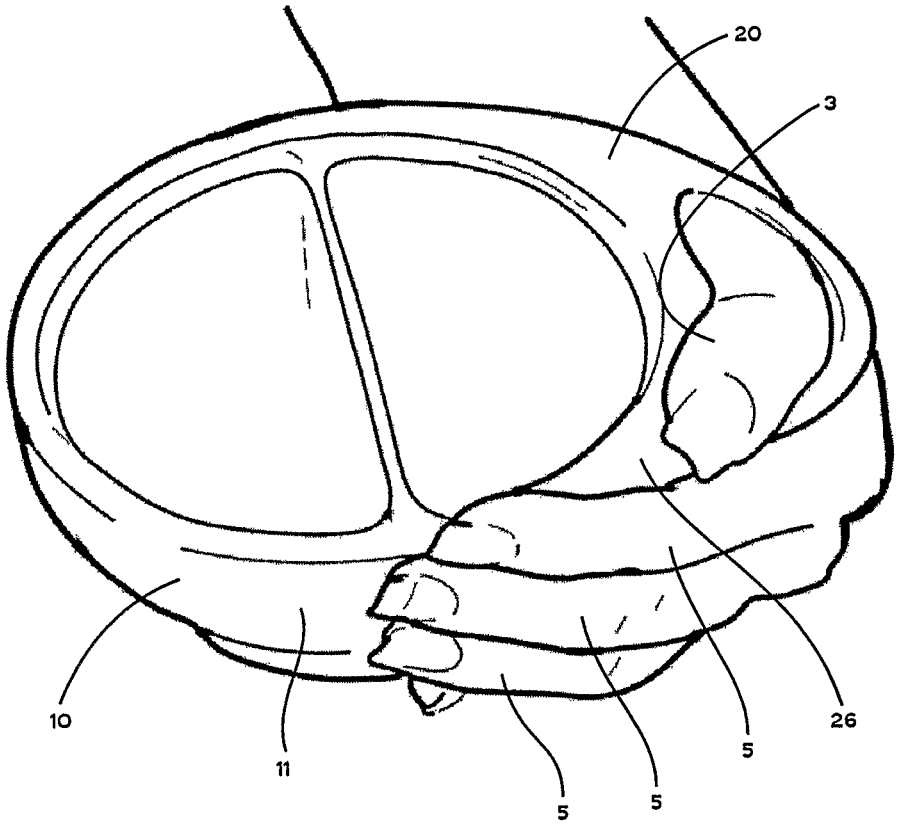

FIGS. 9 and 10 show how the bowl container 10 of the infant feeding bowl 1 herein may be held with one hand of a user. Thus, the user's thumb 3 is received up through thumbhole 24 such that the body of the user's thumb rests against the top of lamellar portion 26 of the handle 20. The palm of the user's hand is supported by the hand support feature (obscured, but refer to earlier drawings). The fingers 5 of the user's hand cup around the outer bowl surface 13. Such a one-handed holding arrangement has been found to be comfortable and practical regardless of which user's hand (i.e. left of right) is employed.

In use, when all foodstuff portions have been dispensed from the bowl container 10 or the compartments 42, 43 of the bowl insert 40 all components of the infant feeding bowl may be separated for washing thereof in a dishwasher or kitchen sink. The component parts may then be re-assembled after washing for commencement of another foodstuff loading and infant feeding operation.

Figure 11:
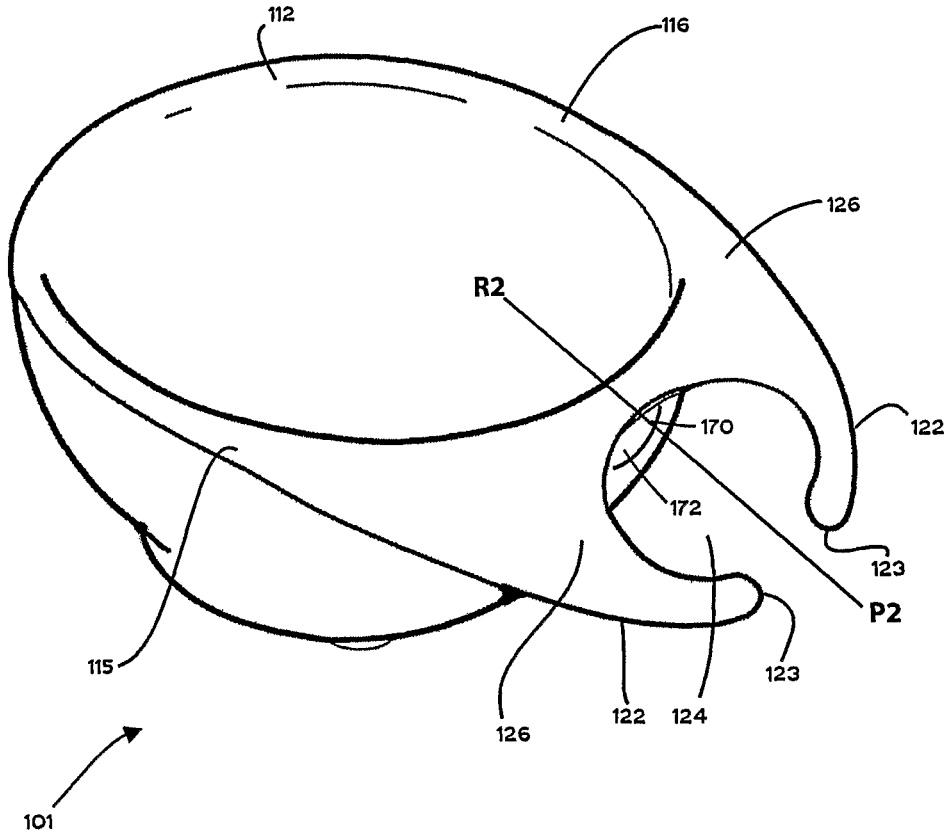
FIG. 11 shows a perspective view of a second infant feeding bowl herein.

FIG. 11 shows an alternative infant feeding bowl 101 herein, which is identical to that previously described in detail in relation to FIGS. 5, 6 and 8 other than that the bowl handle 120 may be seen to define a 'broken arc' form 122 where arc ends 123 are defined about the break point. All other aspects correspond: Thus, the bowl handle 120 may be seen to extend generally at two points 115, 116 from the bowl rim 112 to define a 'broken arc' form handle rim 122, although it will also be appreciated that the bowl rim 112 and the handle rim 122 are integrally formed. Lamellar portion 126 extends from the 'broken arc' form handle rim 122 to the bowl rim 120 and is provided with a thumbhole 124 arranged for receipt of the user's thumb in use.

Chord axis P2-R2 extends from the broken peak 'P2' of the 'broken arc' form handle rim 122 to the rim 112 of the bowl container 110. It will be seen that the thumbhole 124 is of generally circular form and is arranged symmetrically about that chord axis. Bowl container 110 is also provided with a hand support feature 170 in the form of a bulge that protrudes from the outer bowl surface to define a convex outer hand support surface 172. That hand support feature 170 lies symmetrically about a vertical plane containing the chord axis P2-R2. Once again, such symmetric arrangement has been found to enable ambidextrous use (i.e. holding in either the user's left or right hand) of the bowl container 110.

Figure 12:
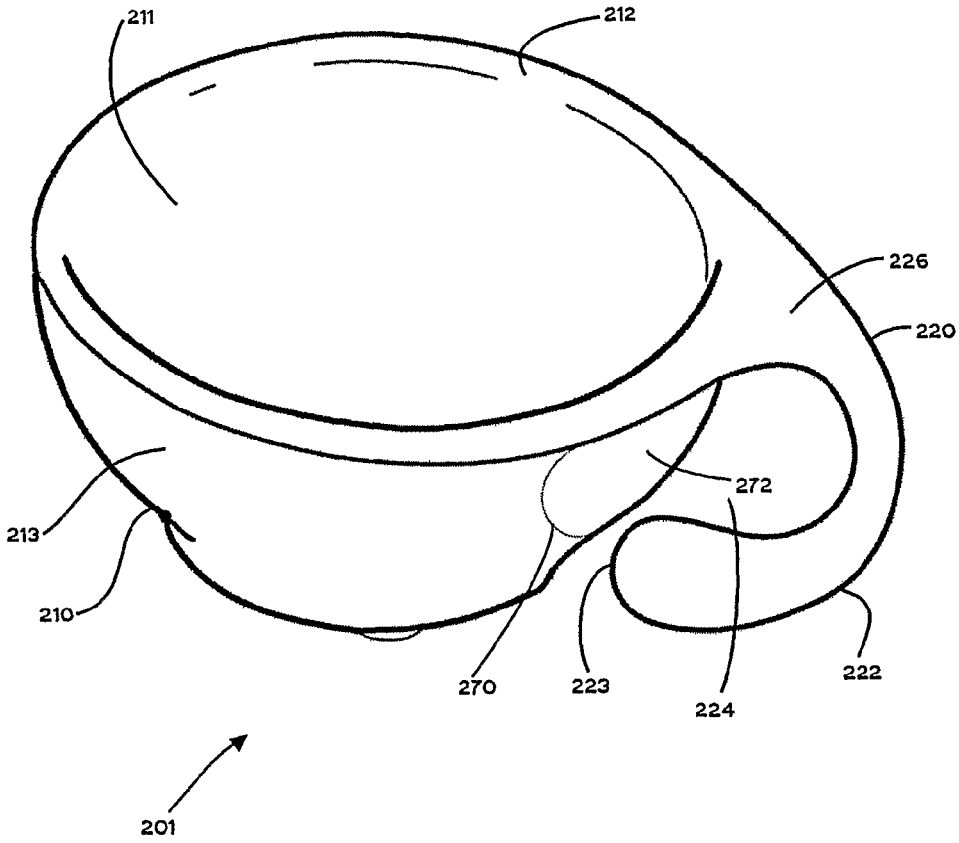
FIG. 12 shows a perspective view of a right-handed version of a third infant feeding bowl herein.
Figure 13:
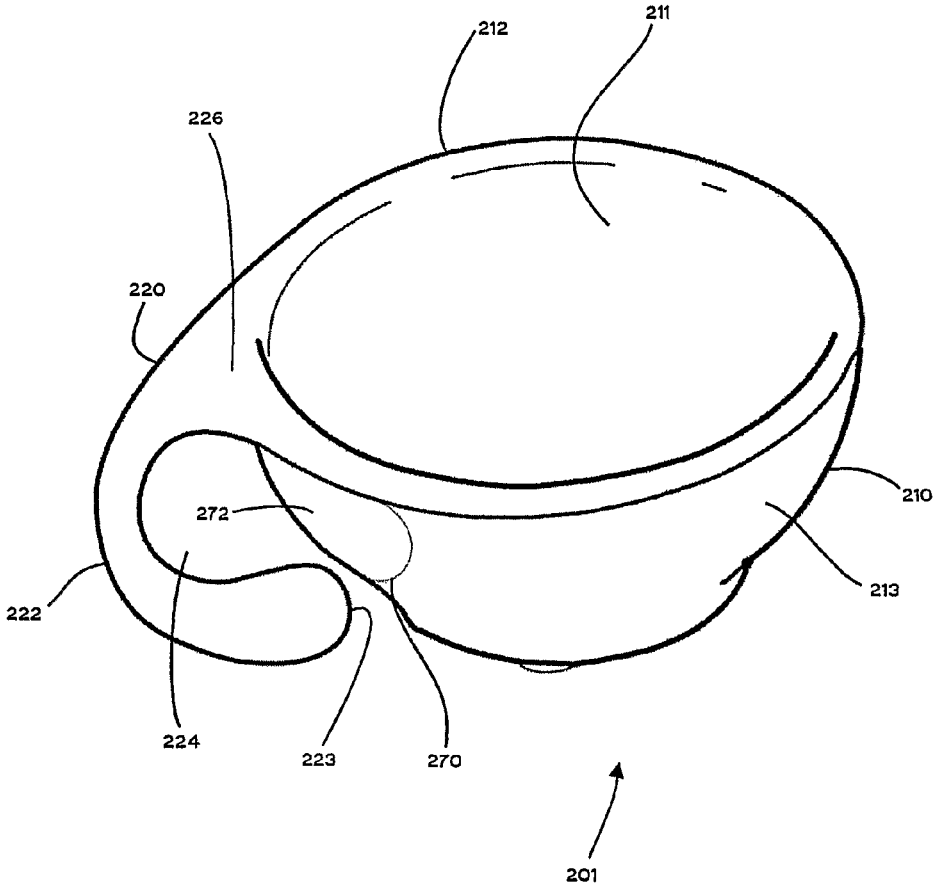
FIG. 13 shows a perspective view of a left-handed version of a third infant feeding bowl herein.
Figure 14:
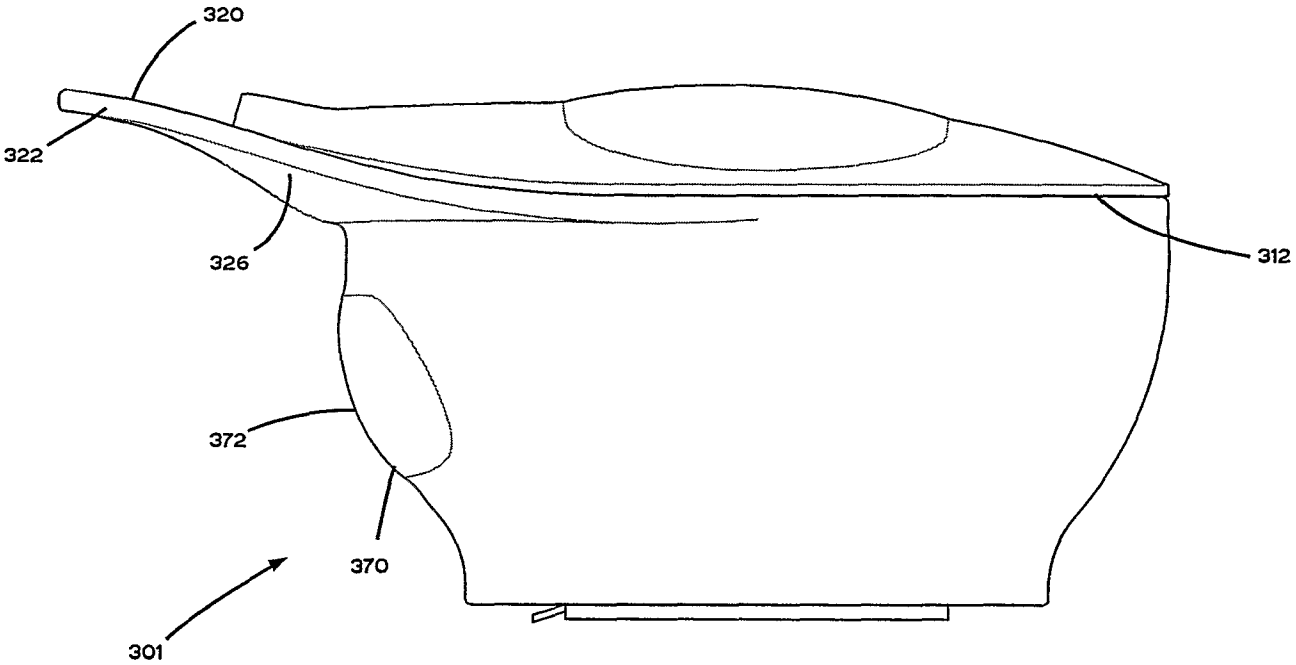
FIG. 14 shows a side view of a fourth infant feeding bowl herein a travel (i.e. 'packed away') configuration thereof.
Figure 15:
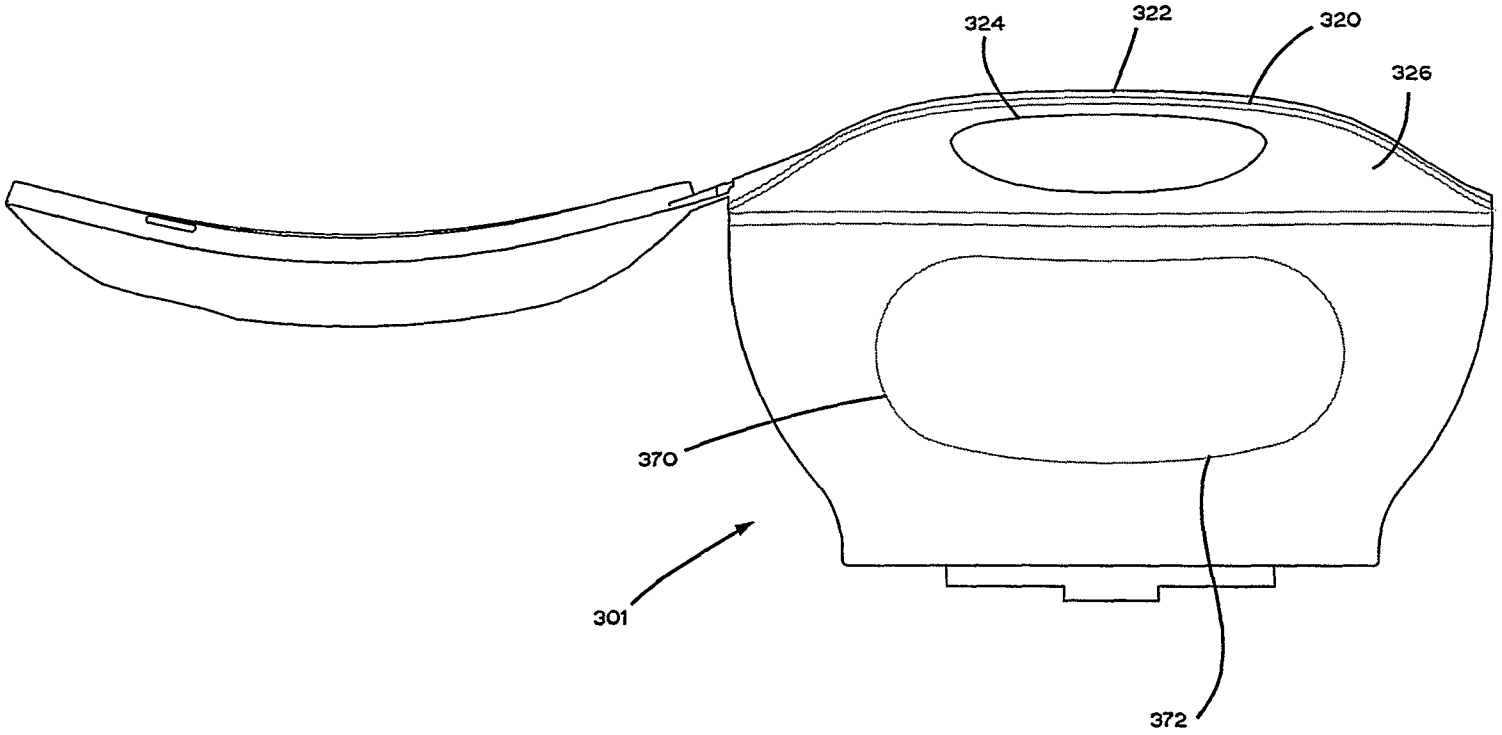
FIG. 15 shows a side view of a fourth infant feeding bowl herein with the sealing lid cavity cover in an open configuration.
Figure 16:
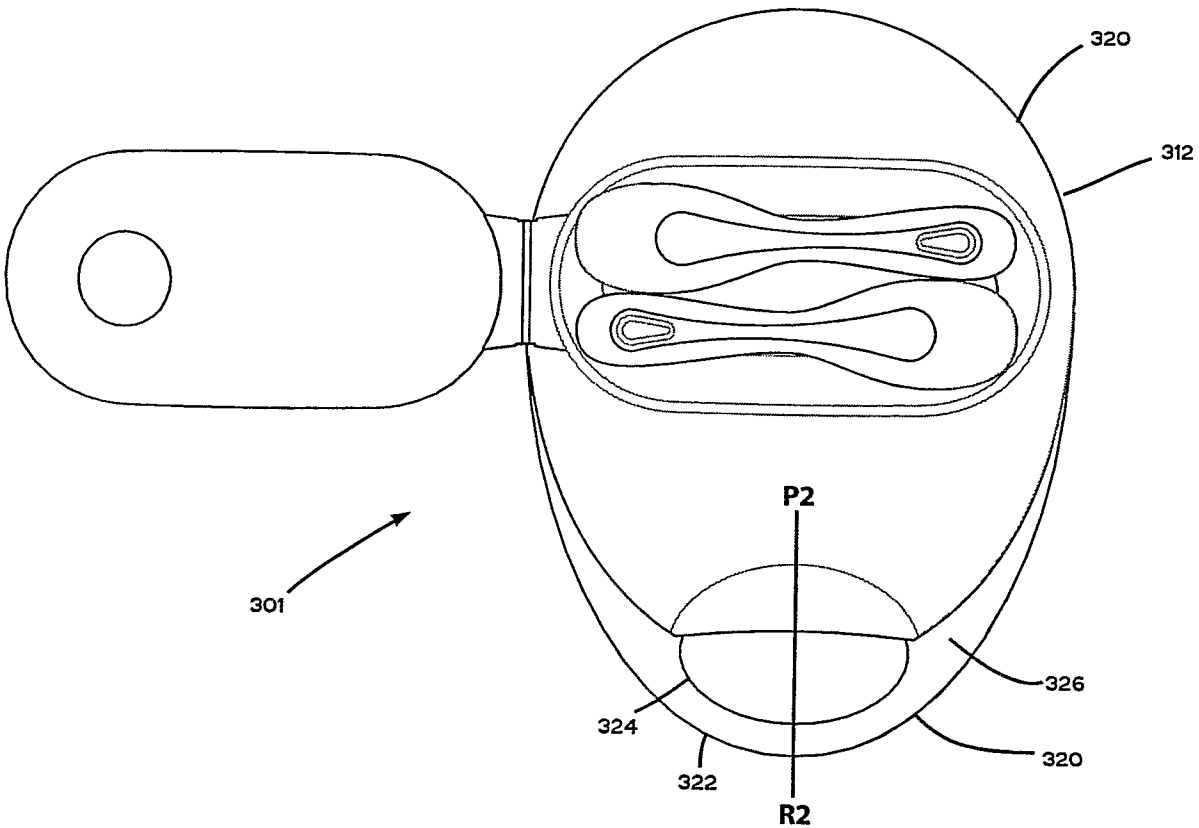
FIG. 16 shows a plan view of a fourth infant feeding bowl herein with the sealing lid cavity cover in an open configuration.
Figure 17:
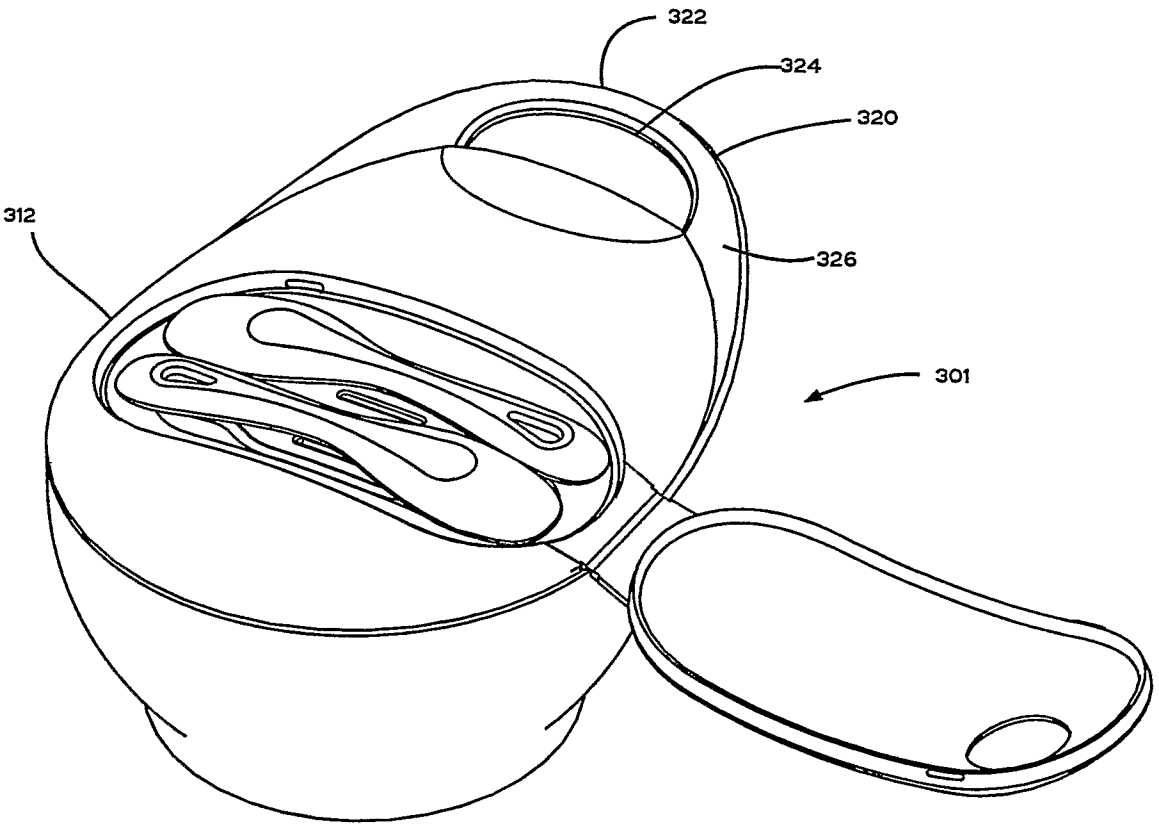
FIG. 17 shows a perspective view from above of a fourth infant feeding bowl herein with the sealing lid cavity cover in an open configuration.
Figure 18:
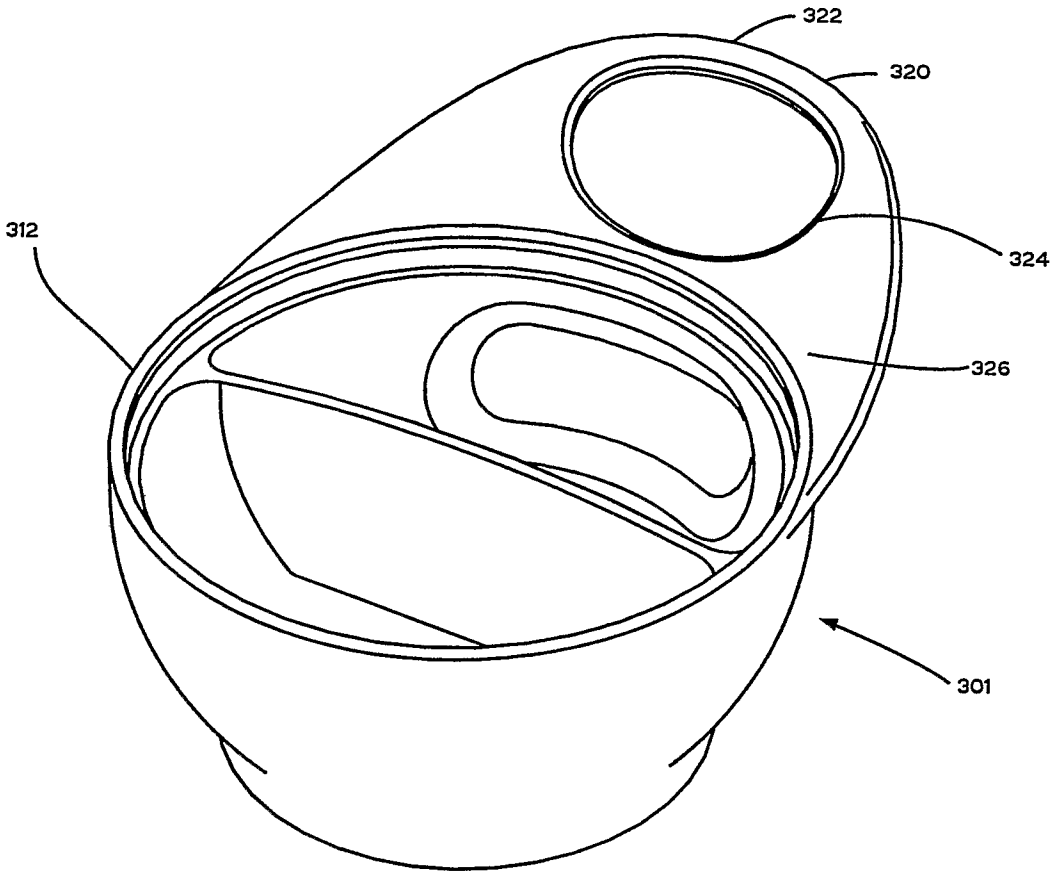
FIG. 18 shows a perspective view from above of a fourth infant feeding bowl herein with the sealing lid removed.

FIGS. 12 and 13 show right and left-handed versions respectively of a third infant feeding bowl 201 herein comprising a bowl container 210 defining an inner bowl surface 211, an outer bowl surface 213 and a bowl rim 212. Projecting away from the bowl rim 212, there is provided a bowl handle 220 defining a partial arc form handle rim 222. The bowl rim 212 and bowl handle 220 are integrally formed. The partial arc form handle 222 defines a rounded end 223 and thickens out towards that rounded end 223. The partial arc form handle rim 222 extends downwards of the plane defined by the bowl rim 212. The bowl handle 220 includes a curved lamellar portion 226 that extends from the partial arc form handle rim 222 to the bowl rim 212 and wherein a thumbhole 224 arranged for receipt of the user's thumb in use, is defined in combination by the partial arc form handle 222, the lamellar portion 226 and the bowl rim 212. The bowl container 210 is further provided with a hand support feature 270 that protrudes from the outer bowl surface 213 to define a hand support surface 272 comprising a palm support surface and optionally a finger support surface.

FIGS. 14 to 18 shows a fourth infant feeding bowl 301 herein, which is generally identical to the first infant feeding bowl previously described in detail in relation to FIGS. 1 to 10 other than that the arc form bowl handle 320 with thumbhole 324 may be seen to extends upwards of the plane defined by the bowl rim 312. Thus, the arc form handle rim 322 of the handle extends upwards relative to the plane defined by the bowl rim 312 such that the lamellar portion 326 is of upwardly curved lamellar form. It may also be seen that the bowl container 310 is provided with a hand support feature 370 in the form of a bulge that protrudes from the outer bowl surface to define a convex outer hand support surface 372. That hand support feature 370 lies symmetrically about a vertical plane containing the chord axis P2-R2 that extends from the arc form handle rim 322 to the bowl rim 312. In use, the hand support feature 370 defines a support surface 372 for supporting the user's palm and optionally also the user's fingers. All other aspects of the fourth feeding bowl 301 correspond generally to those of the first feeding bowl 1 of FIGS. 1 to 10.

The application of which this description and claims form part may be used as a basis for priority in respect of any subsequent application. The claims of such subsequent application may be directed to any feature or combination of features described therein. They may take the form of product, method or use claims and may include, by way of example and without limitation, one or more of the following claims:

The invention claimed is:

1. An infant feeding bowl comprising a bowl container defining an inner bowl surface, an outer bowl surface and a bowl rim; and projecting away from said bowl rim, a bowl handle defining an arc form handle rim;

wherein said bowl handle includes a lamellar portion that extends from said handle rim to the bowl rim and provided to said lamellar portion, a thumbhole arranged for receipt of the user's thumb in use, and wherein said thumbhole is arranged symmetrically about a chord axis extending from the arc form handle rim to the bowl rim, wherein the bowl container is provided with a hand support feature that protrudes from the outer bowl surface to define a hand support surface, wherein said hand support feature lies on or about a vertical plane containing said chord axis extending from the arc form handle rim to the bowl rim, wherein the bowl container is provided with a bowl insert that defines plural open compartments each arranged for holding a distinct portion of a foodstuff, and wherein said bowl insert is provided with an alignment feature that is arranged to align with a reverse surface of the hand support feature provided to the inner bowl surface.

2. An infant feeding bowl according to claim 1, wherein the arc form handle rim extends upwards or downwards of the plane defined by the bowl rim.

3. An infant feeding bowl according to claim 1, wherein the bowl rim and the handle rim are integrally formed.

4. An infant feeding bowl according to claim 2, wherein the lamellar portion is of curved lamellar form.

5. An infant feeding bowl according to claim 1, wherein the hand support feature lies symmetrically on or about said vertical plane containing the chord axis.

6. An infant feeding bowl according to claim 1, wherein the hand support feature defines a palm support surface.

7. An infant feeding bowl according to claim 1, wherein the hand support feature defines a finger support surface.

8. An infant feeding bowl according to claim 1, wherein the hand support feature defines a convex hand support surface profile.

9. An infant feeding bowl according to claim 1, wherein the hand support feature defines a reverse surface that extends into the inner bowl surface.

10. An infant feeding bowl according to claim 9, wherein said reverse surface defines a concave surface profile.

11. An infant feeding bowl according to claim 9, wherein the reverse surface provides a spoon wipe surface at the inner bowl surface.

12. An infant feeding bowl according to claim 1, wherein a sealing lid is provided to the bowl container, wherein said sealing lid interacts in sealing fashion with the bowl rim.

13. An infant feeding bowl according to claim 12, wherein the sealing lid is provided with a lid cavity therein arranged for the receipt of one or more items of cutlery.

14. An infant feeding bowl according to claim 13, wherein a lid cavity cover is provided to said lid cavity.

15. An infant feeding bowl according to claim 14, wherein said lid cavity cover is provided with a spoon rest area.

16. An infant feeding bowl according to claim 1, wherein a base of the outer bowl surface is provided with one or more grip features for gripping to a table top surface.

17. An infant feeding bowl according to claim 16, wherein each of the one or more grip features comprises a mat or a sucker.

18. An infant feeding bowl according to claim 1, additionally comprising a bowl lid for the bowl container, wherein the bowl rim defines a convex rim surface and said bowl lid defines a lid rim defining a concave rim surface arranged for mating contact with said convex rim surface of the bowl rim.

19. An infant feeding bowl according to claim 18, wherein the bowl rim defining the convex rim surface is provided to the bowl container as a separate moulded part thereto.

20. An infant feeding bowl according to claim 19, wherein the bowl rim is adhesively mounted or weld mounted to the bowl container.

21. An infant feeding bowl according to claim 18, wherein the bowl rim defines a circular or ovular cross-sectional profile such that the convex rim surface thereof is defined as part of the circumference thereof.

22. An infant feeding bowl according to claim 21, wherein the concave rim surface of the bowl lid interacts with from 100 to 250° radial segment of said circumference.

23. An infant feeding bowl according to claim 18, wherein the lid rim defines an inner circumferential skirt, which projects downwards therefrom.

24. An infant feeding bowl according to claim 23, wherein a circumferential groove is defined in combination between said inner circumferential skirt, part of the convex rim surface and an upper part of a circumferential bowl wall which defines the upper part of the inner bowl surface.

25. An infant feeding bowl according to claim 24, wherein said circumferential groove is arranged for receipt of the uppermost part of a bowl insert that is receivable by the bowl container.

26. An infant feeding bowl comprising a bowl container defining an inner bowl surface, an outer bowl surface and a bowl rim; and a partial arc form handle rim;

wherein said bowl handle includes a lamellar portion that extends from said partial arc form handle rim to the bowl rim and wherein a thumbhole arranged for receipt of the user's thumb in use is defined in combination by the partial arc form handle, said lamellar portion and the bowl rim, and wherein said thumbhole is arranged symmetrically about a chord axis extending from the arc form handle rim to the bowl rim, wherein the bowl container is provided with a hand support feature that protrudes from the outer bowl surface to define a hand support surface, wherein said hand support feature lies on or about a vertical plane containing said chord axis extending from the arc form handle rim to the bowl rim, wherein the bowl container is provided with a bowl insert that defines plural open compartments each arranged for holding a distinct portion of a foodstuff, and wherein said bowl insert is provided with an alignment feature that is arranged to align with a reverse surface of the hand support feature provided to the inner bowl surface.

27. An infant feeding bowl according to claim 26, wherein the partial arc form handle defines a rounded end and thickens out towards said rounded end.

28. An infant feeding bowl according to claim 26, wherein the partial arc form handle rim extends upwards or downwards of the plane defined by the bowl rim.

29. An infant feeding bowl according to claim 26, wherein the bowl rim and the partial arc form handle rim are integrally formed.

30. An infant feeding bowl according to claim 28, wherein the lamellar portion is of curved lamellar form.

* * * * *